US006895960B2

(12) United States Patent
Fabin

(10) Patent No.: US 6,895,960 B2
(45) Date of Patent: May 24, 2005

(54) MODULAR RESPIRATORS AND A METHOD OF CONVERSION THEREOF

(75) Inventor: Frank J. Fabin, Eagan, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 125 days.

(21) Appl. No.: 09/765,224

(22) Filed: Jan. 18, 2001

(65) Prior Publication Data

US 2002/0092522 A1 Jul. 18, 2002

(51) Int. Cl.[7] ..... A62B 17/04

(52) U.S. Cl. ..... 128/201.23; 128/201.12; 128/201.22; 128/201.24; 128/202.27; 128/206.12; 2/15; 2/443

(58) Field of Search ..... 128/201.12, 201.22, 128/201.23, 201.24, 202.27, 205.25, 206.12, 206.16, 206.17; 2/6.3, 6.4, 6.5, 6.7, 15, 427, 443

(56) References Cited

U.S. PATENT DOCUMENTS

| | | | | | |
|---|---|---|---|---|---|
| 1,251,657 | A | * | 1/1918 | Hart | 128/206.28 |
| 2,529,106 | A | * | 11/1950 | Schauweker | 128/201.25 |
| 2,881,758 | A | * | 4/1959 | Motsinger | 128/201.25 |
| 2,882,894 | A | * | 4/1959 | Fahey et al. | 128/201.24 |
| 2,918,060 | A | * | 12/1959 | Lobelle | 2/424 |
| D261,073 | S | * | 10/1981 | Spruill et al. | D2/232 |
| 4,462,119 | A | * | 7/1984 | Rudd | 2/424 |
| 4,484,575 | A | | 11/1984 | Brockway et al. | 128/201.23 |
| 4,542,538 | A | | 9/1985 | Moretti et al. | 2/438 |
| 4,573,217 | A | * | 3/1986 | Reed | 2/7 |
| 4,577,375 | A | | 3/1986 | Beaussant | 24/580 |
| 4,619,254 | A | | 10/1986 | Moretti et al. | 128/201 |
| 4,648,394 | A | * | 3/1987 | Wise | 128/201.24 |
| 4,764,990 | A | * | 8/1988 | Markert | 2/429 |
| 4,768,235 | A | | 9/1988 | Webster | |
| H863 | H | * | 1/1991 | Kwiedorowicz et al. | 2/424 |
| 5,003,632 | A | | 4/1991 | Claude | 2/6 |
| 5,077,870 | A | | 1/1992 | Melbye et al. | 24/452 |
| H1023 | H | * | 3/1992 | Wiseman, Sr. | 2/438 |
| 5,163,185 | A | | 11/1992 | Hodnett | |
| 5,181,506 | A | * | 1/1993 | Tardiff, Jr. et al. | 128/201.22 |
| H1360 | H | * | 10/1994 | Grove et al. | 128/201.25 |
| 5,508,084 | A | | 4/1996 | Reeves et al. | 428/172 |
| 5,555,569 | A | * | 9/1996 | Lane | 2/424 |
| 5,575,278 | A | * | 11/1996 | Bonhomme et al. | 128/201.29 |
| 5,653,225 | A | | 8/1997 | Schegerin | |
| 5,924,420 | A | | 7/1999 | Reischel et al. | 128/206.21 |
| 6,006,360 | A | * | 12/1999 | Reed | 2/202 |
| 6,102,033 | A | | 8/2000 | Baribeau et al. | |
| 6,161,538 | A | * | 12/2000 | Bonhomme et al. | 128/204.21 |
| 6,176,239 | B1 | * | 1/2001 | Grove et al. | 128/206.24 |
| 6,266,828 | B1 | * | 7/2001 | Corsini | 2/424 |
| 6,328,031 | B1 | * | 12/2001 | Tischer et al. | 128/201.25 |
| 6,478,025 | B1 | * | 11/2002 | Yort et al. | 128/201.25 |
| 6,578,572 | B2 | * | 6/2003 | Tischer et al. | 128/201.25 |

OTHER PUBLICATIONS

Merriam Webster's Collegiate Dictionary 10th edition, ppgs, 1052 & 1056.*

* cited by examiner

*Primary Examiner*—Henry Bennett
*Assistant Examiner*—Amanda Flynn

(57) ABSTRACT

A modular respirator system has interchangeable facial lenses and body seals such as a full facepiece seal or a hood. A method of conversion from a full facepiece respirator to a hood respirator, or vice versa, is also disclosed. In one embodiment, lens conversion is accomplished without changing the type of body seal. In another embodiment, a breathable gas delivery conduit is connected to the facial lens and interchanged between the body seals together with the facial lens.

11 Claims, 9 Drawing Sheets

MODULAR RESPIRATORS AND A METHOD OF CONVERSION THEREOF

BACKGROUND OF THE INVENTION

The present invention relates to respirators, and specifically to a modular respirator system and method of converting components between respirators.

Respirators for providing a breathable air supply to a wearer are well known and have been used for many years. Such respirators include masks used by firefighters, in the military, and in industrial applications where the air supply may be contaminated. In addition to providing a clean air source to the nose and mouth for breathing, full face shields also protect the eyes and face from harmful or irritating gases and other substances. Such masks typically include a transparent face shield and may also include mounts for accepting detachable and replaceable filter elements or connectors to air supplies.

There are a number of specific types of respirators in common use, including filtering facepieces, half face masks or half facepiece respirators, full facepiece respirators, hood respirators, or hood respirators combined with a facepiece. Each respirator is of a fixed, single design, lacking modularity and interchangeability.

Hood respirator examples are described in U.S. Pat. No. 4,619,254 to Moretti, et al., which discloses a protective respirator hood for use with half or full-face respirator masks as well as for use as a supplied air respirator hood. A portion of the flexible hood material provided is integrated with a respirator that is then sealed over the nose and the mouth of the user.

Other examples of protective respirator hoods include those described in U.S. Pat. No. 4,484,575 to Brockway and U.S. Pat. No. 4,542,538 to Moretti. The Brockway patent describes a respirator hood with an integrated lens panel. The use of a negative pressure cartridge mounted through the lens of the respirator hood is also provided. The Moretti patent describes a respirator hood with a flexible transparent film accessory for use with an optical transparent lens panel. The transparent film array is disposable but is not designed to be used interchangeably with a different kind of hood or facepiece respirator. More importantly, the lens panel itself is integrated with the hood and has no modularity.

Minnesota Mining and Manufacturing Company, St. Paul, Minn., makes a variety of respirator assemblies (such as the 3M 6000 Series Respirators) that use disposable and interchangeable filters and cartridges for different kinds of environments. However, these respirators have no provision for interchangeable face shields.

Although some degree of component interchange may be achievable in each of the aforementioned protective respirators, such variations are limited to choosing from a range of selectable breathing elements, disposable lens shielding, and various forms of air supply.

The drawback in existing respirator hood designs that limits versatility of use and field configurability lies in the integrated nature of the hood and shield. No provision is made in the prior respirator designs to allow interchange of the hood element and the shield. Likewise, the prior art designs do not contemplate the interchangeability of the shield component between a respirator hood and a full facepiece respirator.

BRIEF SUMMARY OF THE INVENTION

The present invention overcomes the above-mentioned difficulties by providing a respirator design that can be configured as a respirator hood, a full-face respirator, or any other similar or equivalent respirators using modular components, particularly an interchangeable face shield component. In one embodiment, a respirator of a first configuration can be converted into a respirator of a second configuration by removing an interchangeable lens component from the first configuration and mounting it to the second configuration. In one embodiment, the interchangeable face shield component is simply a facial lens. In another embodiment, however, the interchangeable face shield component includes a facial lens and a full facepiece seal which is fitted around the lens. In this latter embodiment, the interchangeable face shield component works as a full facepiece respirator itself when connected to proper respiratory means, but can be converted to a hood respirator by superpositioning a hood over the full facepiece respirator.

In addition, the present invention can be field converted between two configurations (e.g., a hood and a full facepiece) without the need for special tools (or any tools). Field conversions could be accomplished through the use of ratcheting or latch mechanisms in conjunction with a band element to provide the connection and seal between the common face shield component and a body seal (such as a full facepiece seal or a hood). In one embodiment, novel mechanical fasteners employing microstructured sealing and retention elements are employed to affix the full-face or hood elements to the lens component.

The ability to transition from a full facepiece respirator to various hood type respirators or vice versa, or from one type of hood respirator to another type of hooded respirator, is a significant feature of this invention. This is accomplished by the use of the specially designed parts that consist of the facepiece, lens frame, lens, hard-hats, suspensions and various hood combinations. In one preferred embodiment, body seals and the common face shield component are coupled via a lens frame tightened around the lens. The lens frame is readily disassembled by a user and either the hood or full facepiece attached thereto. Alternatively, the lens frame has a securing component that allows disassembly and reassembly without the need for tools or special equipment. This modularity provides the user with the ability to change the respirator to the user's particular needs and to realize both economies and conveniences. In addition, the user can replace worn, soiled or contaminated components as needed and as desired. A further advantage of this invention is that a variety of hoods may be interchanged with other respirator components, from traditional loose fitting types to tight fitting hoods. This gives the user the ability to utilize air delivery from an air compressor via piping and hoses, or from a powered air purifying respirator (PAPR). With a tight fitting hood, positive pressure air can be provided to the user by self contained breathing apparatus (SCBA) or the respirator can be used in the negative pressure mode (where the user inhales air through filters).

BRIEF DESCRIPTION OF THE DRAWINGS

The present invention will be further explained with reference to the drawing figures listed below, wherein like structure is referred to by like numerals throughout the several views.

Figure 1:
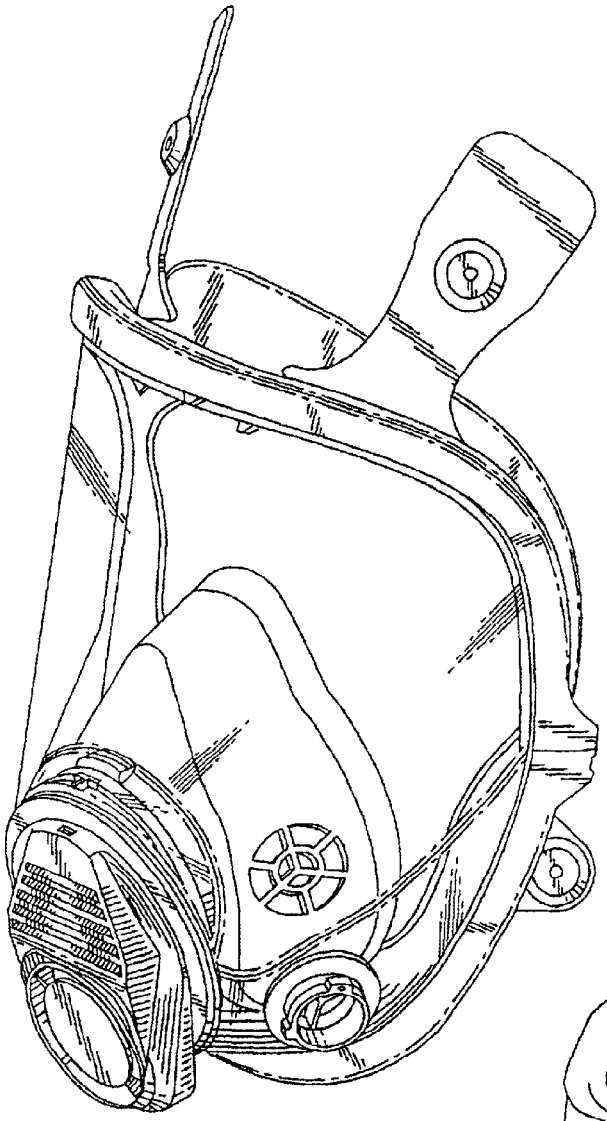
Fig. 1 PRIOR ART
FIG. 1 shows a front perspective view of a prior art full facepiece respirator, such as disclosed in U.S. Pat. No. 5,924,420.

While the above-identified drawing figures set forth several preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION OF THE PREFERRED EMBODIMENTS

The invention relates to a modular respirator that can be converted to either a full facepiece respirator or a hood respirator, depending on the desires of the user and conditions. According to the present invention, a complete respirator configuration can be generally described as comprising (1) an interchangeable face shield component, (2) a removable body seal suitable for coupling with the interchangeable face shield component forming a seal with the face shield component along the contacting edges, and (3) a breathable gas delivery conduit (respiratory means) which may include an air supply pipe, a breathable airway, and filtering components. In one embodiment, however, part or all of the respiratory means is coupled with the face shield component and considered as part of the interchangeable face shield component.

In different types of embodiments, the interchangeable face shield component can be any of the following: (1) a bare facial lens; (2) a facial lens with a lens frame extending around the lens; (3) a facial lens with ports for receiving necessary respiratory means; (4) a facial lens coupled with respiratory means; (5) a facial lens coupled with a half-face mask or a nose cup; (6) a facial lens coupled with a full facepiece seal; and (7) any practical combination of the above. The interchangeable face shield component therefore always includes a facial lens but in some embodiments also includes the above-identified other components attached to the lens. The facial lens may be any type known in the art such as a transparent lens, a tinted lens, a coated lens or a special lens translucent to a narrow range of light in the spectrum (e.g., UV light).

It is to be understood that designating any of the above configurations as an "interchangeable face shield component" only suggests that the component may be interchanged as a whole unit, but does not suggest that the component is configured as a single integral unit to prevent further interchangeability of any parts of the component such as the respiratory means, half face mask, nose cup, or full facepiece seal. It is therefore a feature of the present invention that the modularity and interchangeability is scalable in that although all components may be made modular, these components are not always removed or interchanged in a single conversion.

Any respirator design employing a body seal and facial lens is potentially useable with the present invention. Exemplary body seals would include a full facepiece seal (e.g., see FIG. 1), a respirator hood (see e.g., FIG. 2), or a full body respirator suit. It is to be understood that in the present invention, a respirator hood with a full facepiece seal is still considered a respirator hood. Likewise, a full body respirator suit with a full facepiece seal is still considered as a full body respirator suit.

The interchangeable face shield component has a perimeter sealing edge around the perimeter edge of the facial lens. That sealing edge may be on the lens itself and/or on some other portion of the face shield component which is attached to the lens. The body seal has a front opening to receive the interchangeable face shield component. A seal can be formed along the perimeter sealing edge of the face shield component and the edge of the front opening on the body seal. The seal formed between the face shield component and the body seal is at least effective to prevent contaminant intrusion into the interior of the respirator (in some cases, this seal may be a hermetic gas-tight seal, but not necessarily). In one embodiment, an integral, peripheral edge of the lens itself is the perimeter sealing edge of the face shield component. In another embodiment, the interchangeable face shield component comprises a facial lens and a lens frame fitted around the lens. In this instance, an outer peripheral edge of the lens frame, rather than that of the lens itself, is the perimeter sealing edge of the face shield component.

In yet another embodiment, the interchangeable face shield component comprises a facial lens and a full facepiece seal coupled either integrally or interchangeably to the lens. In this embodiment, the perimeter edge of the lens defines a perimeter sealing edge. The full facepiece seal is preferably coupled to the lens using a lens coupling frame or a bracket fitted around the lens along the perimeter edge of the lens. When desired, the coupling frame or the bracket may be removed, a hood is superpositioned over the full facepiece seal, and the coupling frame or the bracket is replaced and tightened again to secure both the hood and the full facepiece seal along the integral, peripheral edge of the lens. When a hood is so superpositioned, a seal is defined along the perimeter sealing edge of the face shield component, the sealing edge of the full facepiece seal and the perimeter edge of the front opening of the hood.

Alternatively, the full facepiece seal is coupled to the lens along the contacting edges without using a frame or bracket. Such coupling may be accomplished by using mechanical fasteners employing microstructured sealing and retention elements. When so coupled, the perimeter edge of the full facepiece seal and the perimeter edge of the lens define an optional second perimeter sealing edge. When desired, a hood can be superpositioned over the full facepiece seal without having to remove the full facepiece seal. When a hood is so superpositioned, a seal is defined between the hood and the face shield component along the second perimeter sealing edge of the face shield component and the sealing edge of the front opening of the hood. It is to be understood that even when a coupling frame or a bracket is used to couple the full facepiece seal and the lens, by employing proper means of coupling such as mechanical fasteners, the hood may be coupled to the interchangeable face shield component without removing the coupling frame or the bracket.

The modularity of the invention provides significant advantages by permitting the user to select the type of respirator needed for personal or environmental reasons. For example, low levels of contaminants may permit a user to employ the full facepiece respirator utilizing the negative pressure mode. If higher levels of protection are required or more comfort is desired, the user can convert the respirator to a tight fitting hood and a positive pressure air delivery system such as filtered air delivered by a powered air purifying respirator (PAPR). Alternatively, other air delivery systems can be selected (such as compressed air system and self contained breathing apparatus (SCBA.)). Specifically, a full facepiece respirator can use a negative pressure air delivery mode with filters and cartridges, air supplied mode with airline connected to air compressor, SCBA, or PAPR. Such fill facepiece respirators typically include a transparent facial lens and may also include mounts or orifices for accepting the replaceable filter elements or connectors to air supplies. Such mounts or orifices may be formed on separate mounting hardware mechanically attached to the facepiece for connecting to breathable air source as in 3M Full Facepiece Respirator 7000 series, or be formed integrally on the facial lens as disclosed in U.S. Pat. No. 5,924,420 to Reischel et al. According to the present invention, since a full facepiece respirator can be easily converted to a tight fitting hood respirator (e.g., the hood coupled with the full facepiece respirator) without having, to replace the respiratory means, all the above modes of air supplies are also available for a tight fitting hood respirator. With the loose fitting hood configuration such as 3M's H-600 series, air delivery can be a PAPR or supplied air from a suitable air source. The air can be supplied either from the back as in 3M's H-600 series, or by using a neck engaging ruff such as disclosed in U.S. Pat. No. 4,484,575 to Brockway. According to the present invention, the loose fitting hood can be adapted to use a modular facial lens, and as a result, interchanging of the modular facial lens can be done without changing or interfering with the separate air supply such as a PAPR.

In addition to the convertibility from one respirator configuration to another, there is also a benefit of replaceability. Should components such as the lens, facepiece or hood become worn or soiled, those components can be easily and quickly replaced in the field.

Figure 2:
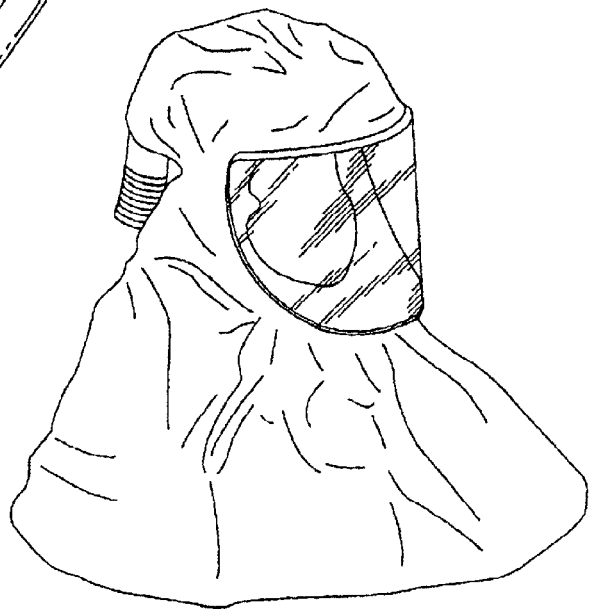
Fig. 2 PRIOR ART
FIG. 2 shows a front perspective view of a typical prior art respirator hood, such as a 3M R-Series hood having a built-in head suspension.

The modularity and interchangeability of the present invention is further illustrated using three different groups of preferred embodiments. In contrast to the prior art respirator systems as shown in FIGS. 1 and 2 which do not offer an interchangeable face shield component, in each embodiment of the present invention, a respirator system comprises a common interchangeable face shield component and a plurality of removable body seals suitable for coupling with the interchangeable face shield component to form a seal with the face shield component along their respective contacting edges.

Figure 3:
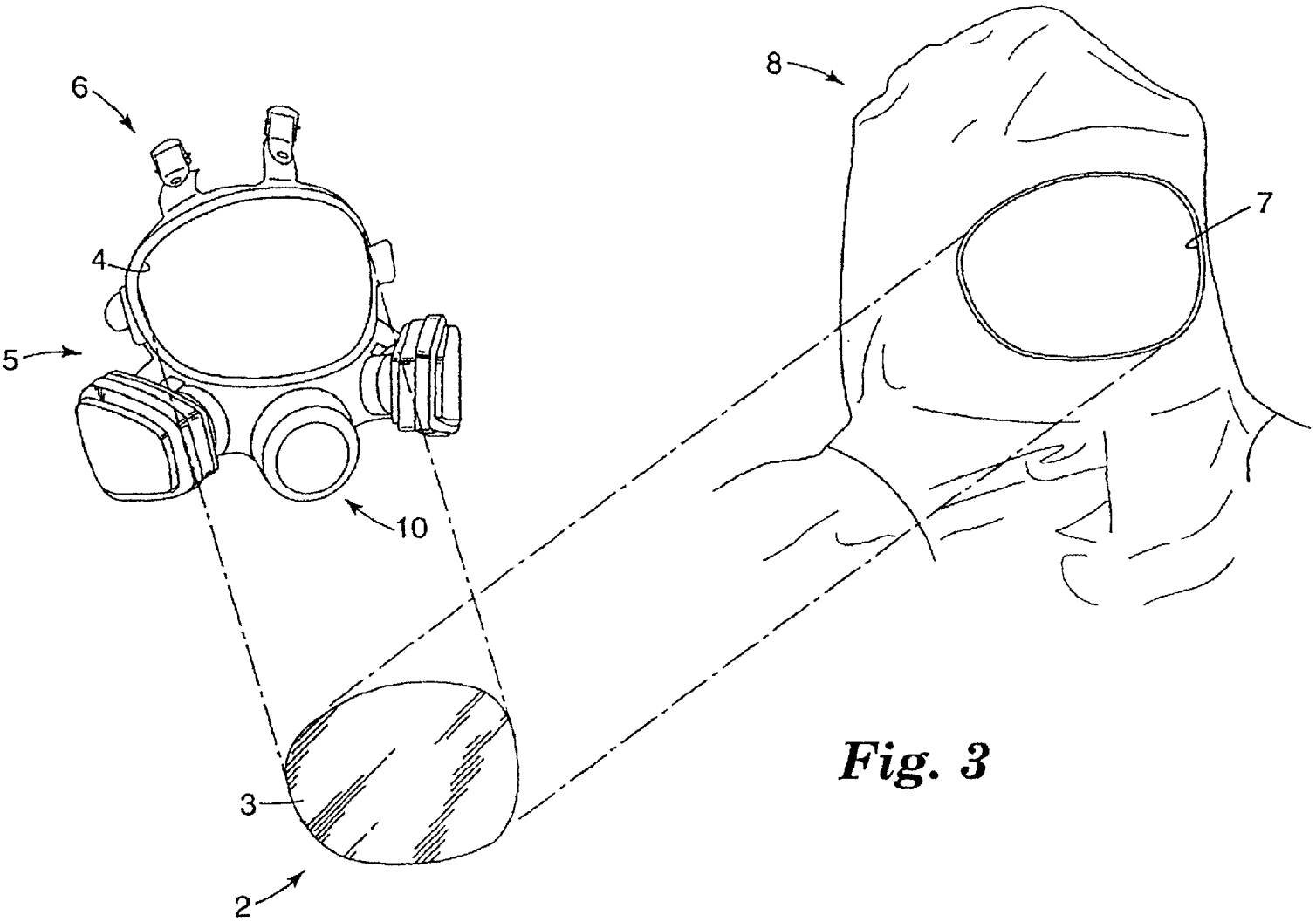
FIG. 3 illustrates, in front elevation, group I embodiments of the present invention in which the common component is a bare facial lens that can interchangeably fit on either a full facepiece seal or a hood body seal.

Group I Embodiments:

As shown in FIG. 3, in Group I embodiments the common component 2 in the interchangeable system is a bare facial lens 3 without attachments to the lens. In one preferred embodiment, for example, the facial lens 3 can be removed from an opening 4 therefor in a full facepiece respirator 5 by disengaging the lens from 3 the full facepiece seal 6. The lens 3 can then be sealably mounted into a like opening 7 on a hood 8. Those respiratory components 10 which provide air or air filtration to the respirator 5 are separate from the lens. Likewise, the air supply for the hood 8 (not shown) is separate from the facial lens 3. Since the facial lens 3 is often required to be an optical lens and is, therefore, expensive to produce, the Group I embodiments enables a user to use the facial lens 3 interchangeably without interfering with the preferred modes of air supply.

Figure 4:
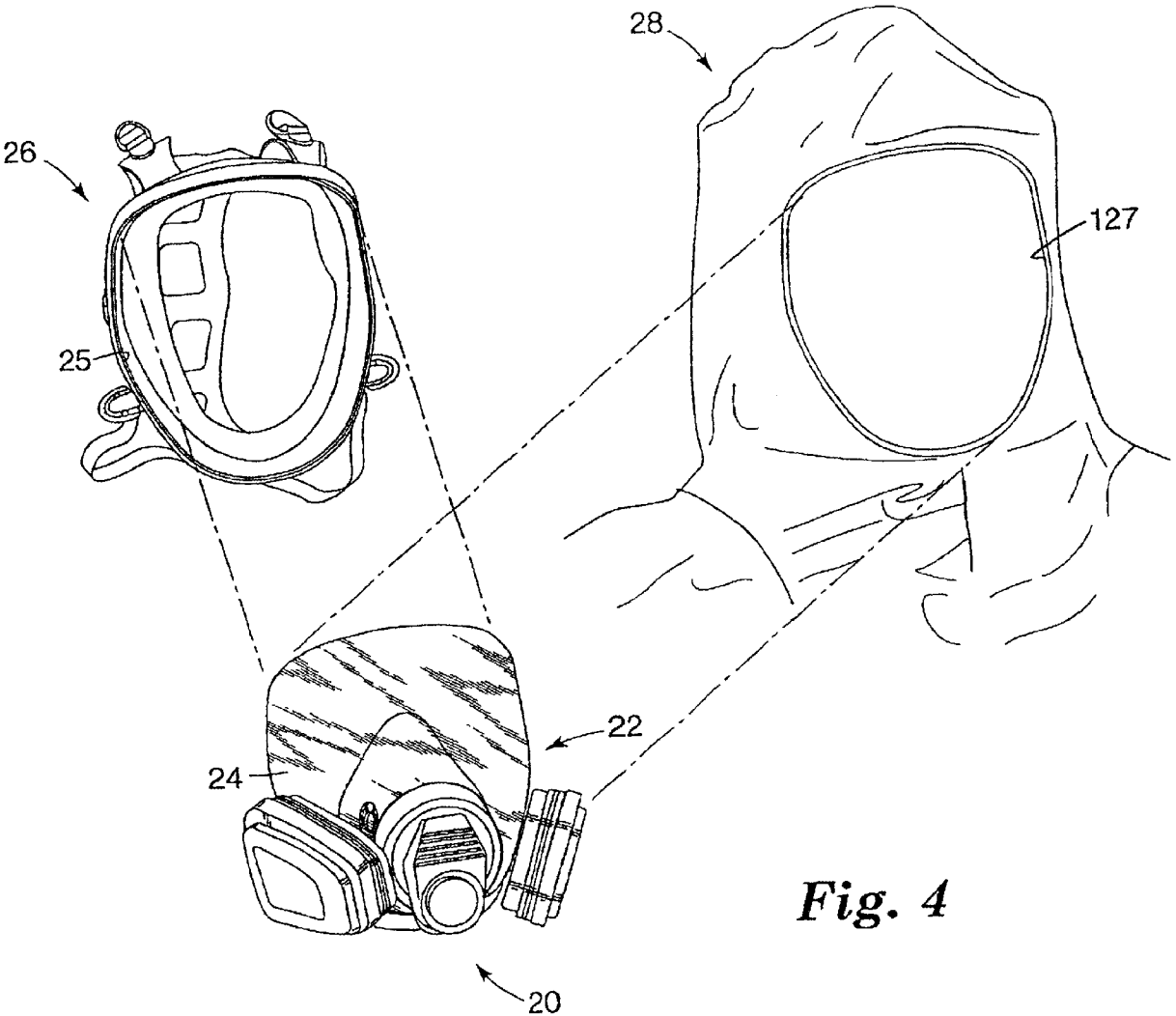
FIG. 4 illustrates, in front elevation, group II embodiments of the present invention in which the common component is a facial lens mounted with respiratory means. The common component can interchangeably fit on either a full facepiece seal or a hood.

Group II Embodiments:

As shown in FIG. 4, in Group II embodiments the common component 22 in the interchangeable system is a facial lens 24 coupled either integrally or separably with necessary respiratory components 20. The common component 22, however, does not include a full facepiece seal behind the lens 24. Such a common component 22 is essentially a full facepiece respirator without a full facepiece seal 26. Assuming a user starts with a full facepiece respirator, the user can remove the common component (i.e., the lens 24 with the coupled respiratory components 20) from the full facepiece respirator by separating the common component 22 from an opening 25 therefor in the full facepiece seal 26, and transferring the common component 22 to a like opening 127 in a second body seal such as a hood 28. The Group II embodiments, therefore, enable a user to replace a full facepiece seal 26 with a variety of hoods 28 to provide special protection for specific contaminants and hazards, or vice versa. The respiratory components 20, if coupled to the lens 24, are carried forward in the conversion, but may also be adapted to facilitate further interchangeability.

Figure 5:
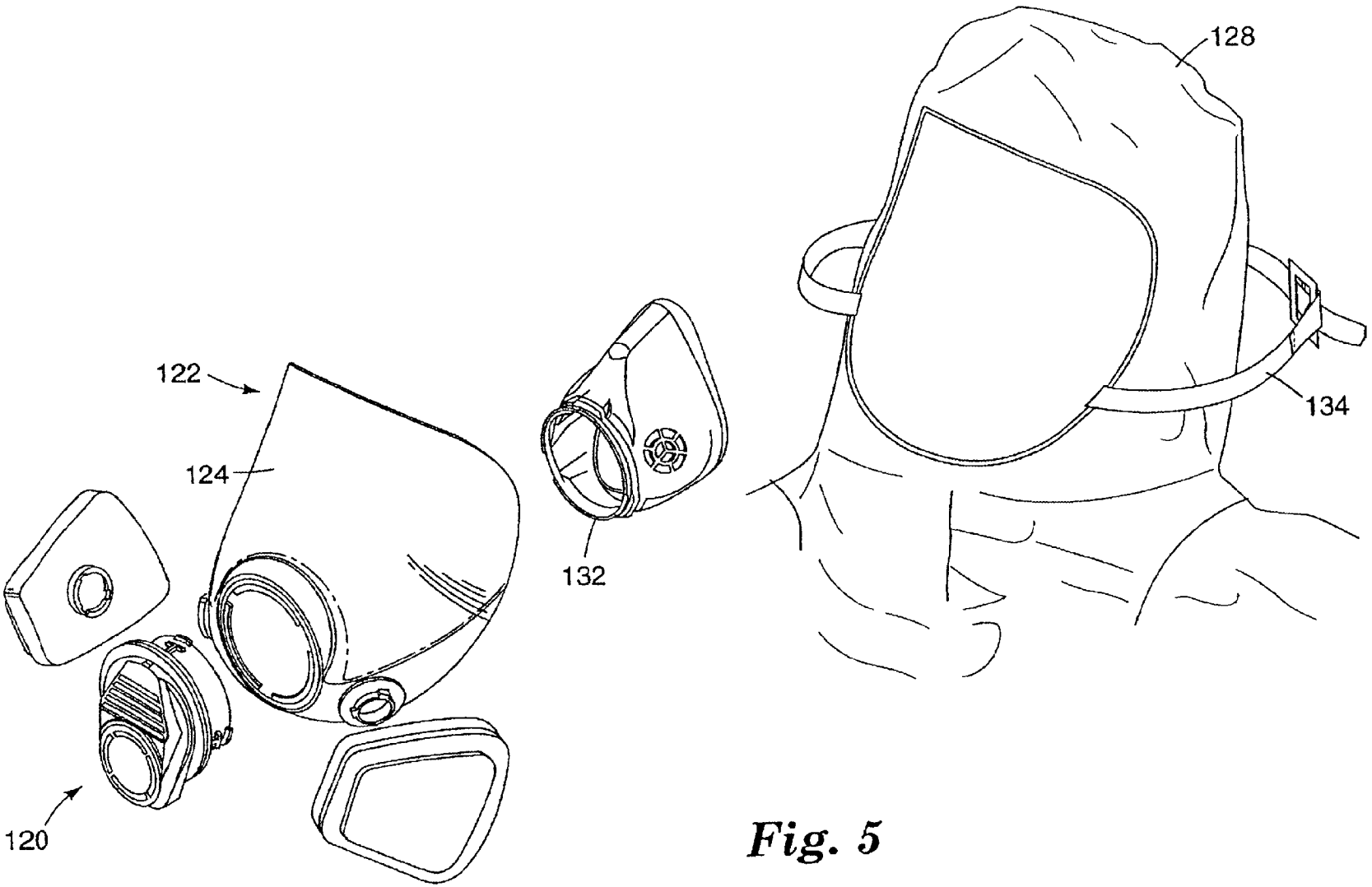
FIG. 5 illustrates, in side elevation, an interchangeable facial lens mounted with respiratory means and a nose cup being fitted to a hood. The hood has a harness that can be used to tighten the nose cup against the user's face.

As shown in FIG. 5, it is to be understood that the respiratory components 120 of a common component 122 may include a half face mask or a nose cup 132, which may be either integrated with the lens 124 or adapted to facilitate further interchangeability or disposability. Where a half face mask or nose cup 132 is attached to the lens 124, a harness is required to tighten the half face mask or the nose cup against the user's face. Although it is possible to accomplish such a task within a hood, it is far more convenient and practical to supply an adjustable harness 134 that is attached to the hood 128 and can be tightened (or loosened) from the outside of the hood 128, preferably from the back of the user. Because the half face mask or the nose cup 132 is connected to the lens 124 and the lens to the hood 128, such a harness 134 can be adapted to tighten the half face mask or the nose cup 132 against the user's face.

Figure 6:
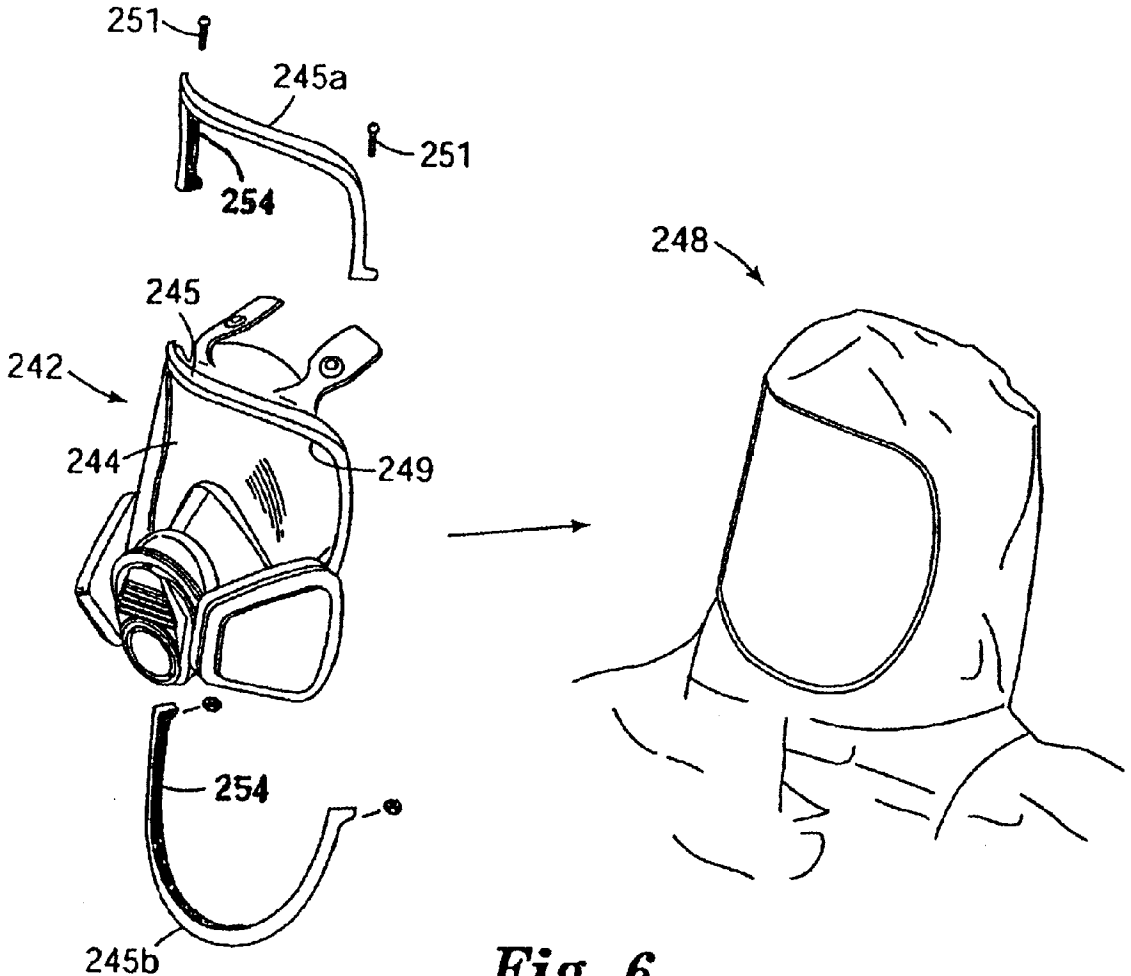
FIG. 6 illustrates, in side elevation, a full facepiece respirator being converted to a respirator hood with a full facepiece seal.
Figure 7:
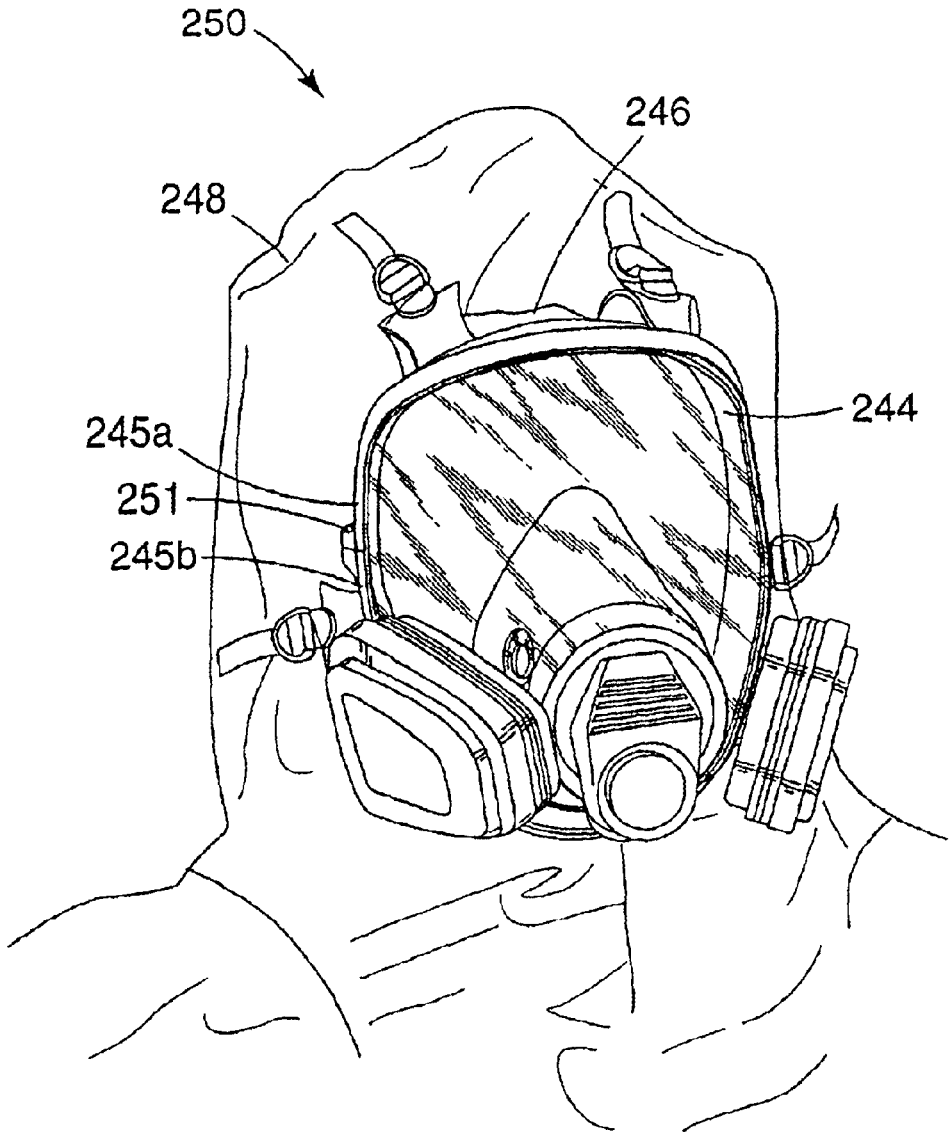
FIG. 7 is a perspective view of a respirator hood with a full facepiece seal, converted from a full facepiece respirator by superpositioning a hood over the full facepiece seal.
Figure 10:
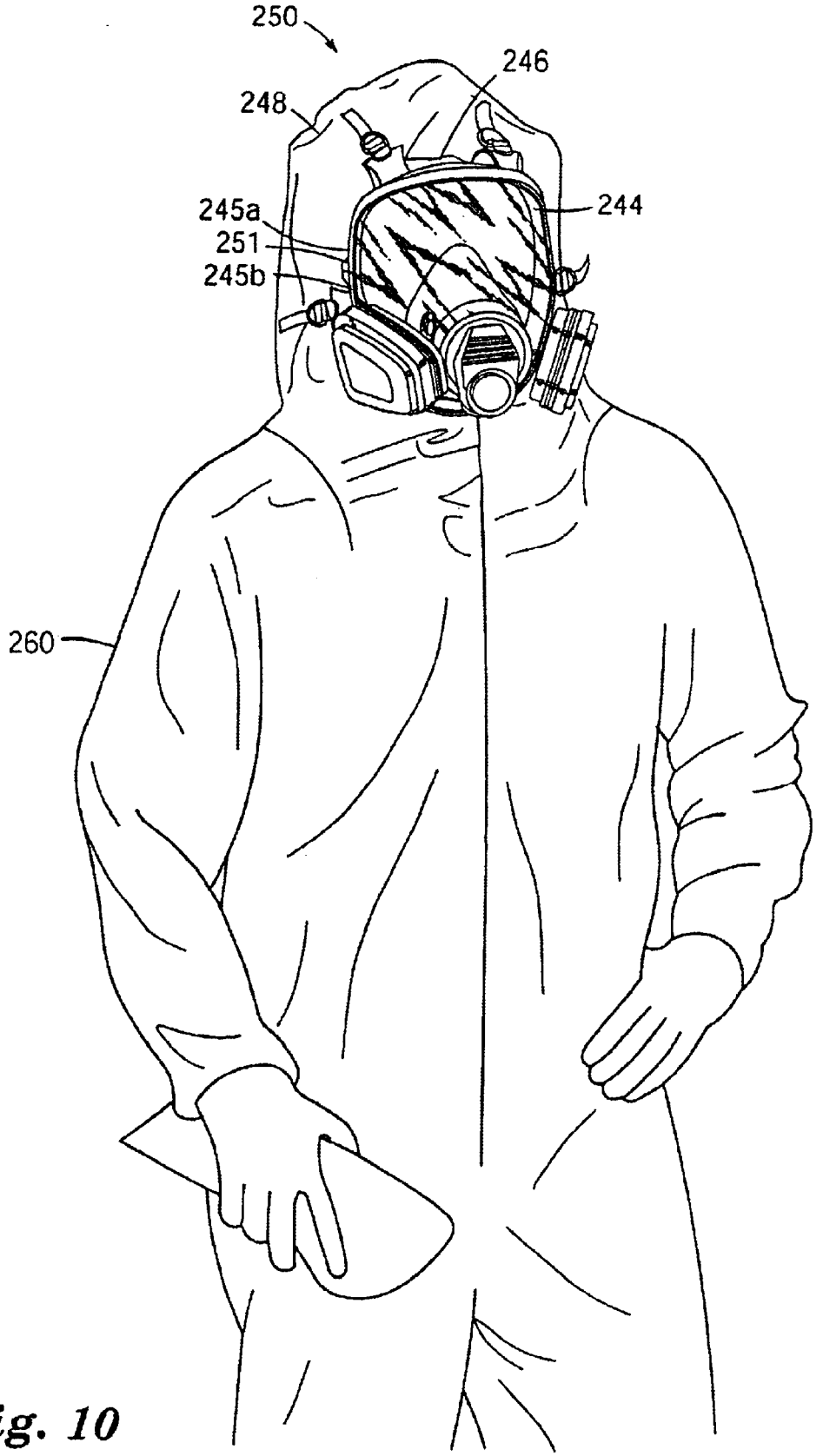
FIG. 10 illustrates a full body respirator suit.

Group III Embodiments:

As shown in FIG. 6, in Group III embodiments the common component 242 comprises a facial lens 244 coupled with a full facepiece seal 246. A user can further couple a hood 248 with the lens 244 without having to remove the full facepiece seal 246. This is accomplished by superpositioning the hood 248 over the full facepiece seal 246. The result is a respirator 250 comprising a hood 248 fitted with a full facepiece seal 246 as shown in FIG. 7. This superpositioning of a hood over and a full facepiece seal can be done in several different ways as described above. In one preferred embodiment, for example, the full facepiece seal 246 is preferably coupled to the lens 244 using lens coupling frame 245 comprising two halves 245*a* and 245*b* fitted around the lens 244 along a perimeter edge 249 of the lens 244. A plurality of threaded fasteners 251 can be used to secure the coupling frame halves 245*a* and 245*b* together. When desired, the coupling frame 245 may be removed, the hood 248 is superpositioned over the full facepiece seal 246, and the coupling frame 245 is replaced and tightened again to secure both the hood 248 and the full facepiece seal 246 along the perimeter edge of the lens 244. Conversely, once configured in the hood mode, the inventive system can be changed to a full facepiece respirator by simply removing the hood. Alternatively, the hood may be replaced by a different hood or a full body respiratory suit 260 (FIG. 10).

It is to be understood that in Group III embodiments, the facial lens may be any of the following: a bare lens, a lens with orifices formed on the surface for the purpose of hosting gas inlet-outlet ports or connectors for air supply pipes, or a lens coupled with the necessary respiratory means.

It is to be further understood that, while the above description called an interchangeable face shield component a "common component", such a designation is done only for the purpose of illustration. Other components, such as the body seal, may be a common component in a particular conversion. For example, a user may start with a hood respirator, and then replace the face shield component with a different face shield component while keeping the hood. In this case, the hood is a common component in the meaning of the above description.

Figure 8:
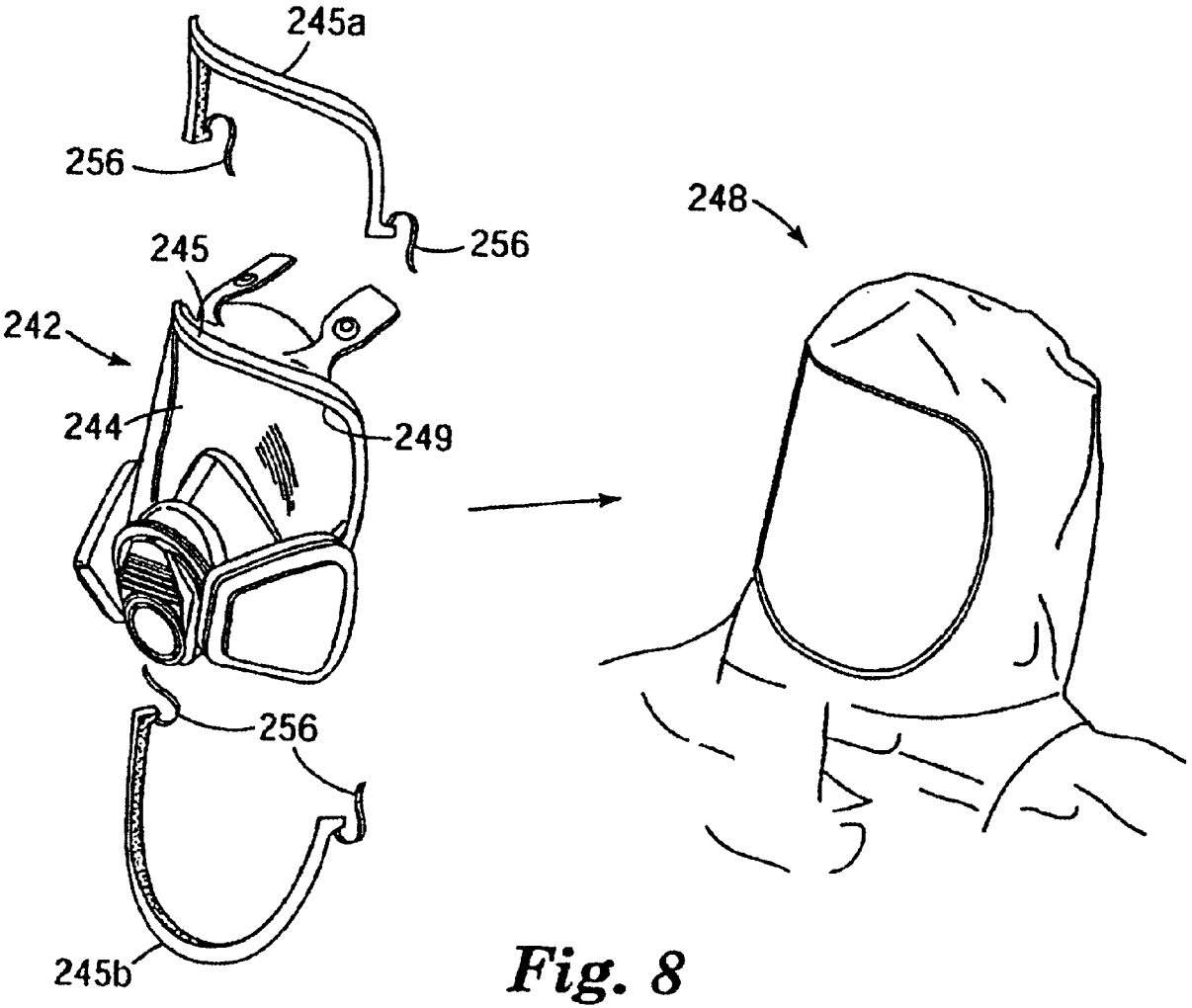
FIG. 8 illustrates a full facepiece respirator being converted to a respirator hood with a full facepiece seal using microstructures sealing surfaces.
Figure 9:
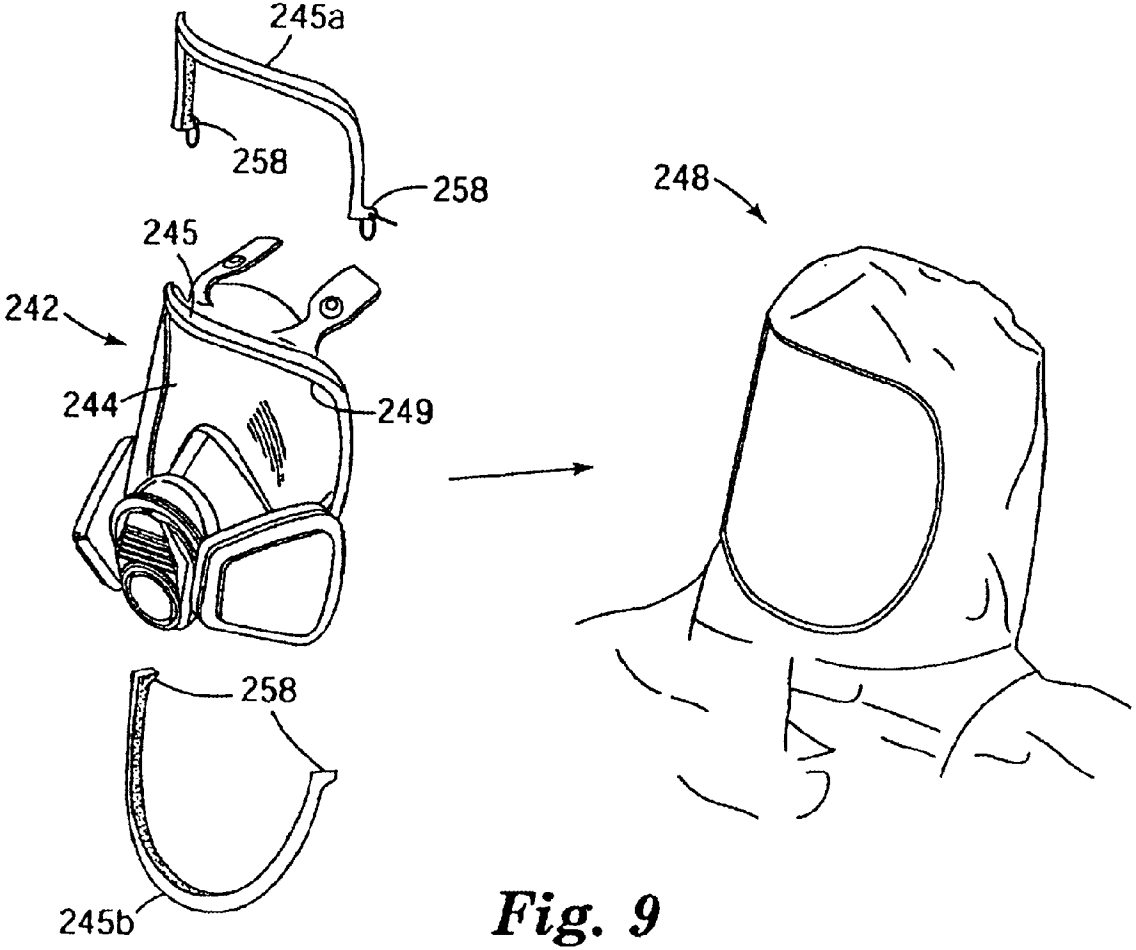
FIG. 9 illustrates a full facepiece respirator being converted to a respirator hood with a full facepiece seal using an elastic band at least partially extended along an opposed rim portion.

In addition to the coupling frame 245 used to sealably couple an interchangeable face shield component and a body seal as shown in FIG. 6, other fastening devices such as a bracket, a band 256 (FIG. 8), a clamp or a latch 258 (FIG. 9) may be used. Furthermore, various fasteners such as those which employ microstructured sealing mechanisms can be used for the same purpose. These fasteners can be used to seal two opposite surfaces together without the assistance of a separate mechanical fastening device. Among these fasteners are the well known hook-and-loop type fasteners, and mushroom-type hook strips disclosed in U.S. Pat. No. 5,077,870 to Melbye et al. Frictional engagement and/or sealing characteristics between opposed rim portions on cooperative sealing components may also be enhanced by forming one or more of the opposed surfaces with microstructured surface features 254 such as disclosed in U.S. Pat. No. 5,508,084 to Reeves et al., or any other equivalences known in the art.

Although the present invention has been described with reference to preferred embodiments, workers skilled in the art will recognize that changes may be made in form and detail without departing from the spirit and scope of invention. All U.S. patents referred in this disclosure are incorporated by reference herein.

What is claimed is:

1. A method of converting a respirator mask from a first type of body seal to a second type of body seal, wherein the respirator mask has a facial lens, the lens having a perimeter sealing edge extending around the lens, the method comprising:

releasing a seal between the perimeter sealing edge of the lens and a lens opening on the first type of body seal;

removing the lens from the lens opening on the first type of body seal;

aligning the lens within a lens opening on the second type of body seal; and forming a seal between the perimeter sealing edge of the lens and the lens opening of the second type of body seal.

2. The method of claim 1 wherein the first type of body seal is selected from the group consisting of a full facepiece seal, a respirator hood, and a full body respirator suit.

3. The method of claim 2 wherein the second type of body seal is selected from the group consisting of a full facepiece seal, a respirator hood, and a full body respirator suit.

4. The method of claim 1 wherein the respirator mask has a clamp element for urging opposed rim portions of the perimeter sealing edge of the lens and the lens opening of the first type of body seal together, and wherein the releasing step comprises:

loosening the clamp element.

5. The method of claim 4 wherein the loosening step comprises:

separating opposed threaded fasteners of the clamp element.

6. The method of claim 4 wherein the loosening step comprises:

elastically disengaging the clamp element from the respirator mask.

7. The method of claim 4 wherein the loosening step comprises:

releasing a latch mechanism of the clamp element.

8. The method of claim 4 wherein the loosening step requires no tools.

9. The method of claim 4 wherein one or both of the opposed rim portions include microstructured sealing surfaces.

10. The method of claim 4 wherein the opposed rim portions include cooperative mechanical engagement surfaces.

11. A method for converting a respirator mask from a full facepiece respirator to a hood respirator, wherein the respirator mask has a facial lens, the lens having a perimeter sealing edge extending around the lens, the method comprising:

releasing a seal on the full facepiece respirator from sealed engagement to the facial lens of the mask about the perimeter sealing edge thereof;

removing the lens from the full facepiece respirator;

aligning a lens opening of a hood respirator in sealed engagement with the perimeter sealing edge of the mask; and sealably affixing the lens opening of the hood respirator to the perimeter sealing edge of the mask.

* * * * *

UNITED STATES PATENT AND TRADEMARK OFFICE

CERTIFICATE OF CORRECTION

PATENT NO. : 6,895,960 B2
DATED : May 24, 2005
INVENTOR(S) : Fabin, Frank J.

It is certified that error appears in the above-identified patent and that said Letters Patent is hereby corrected as shown below:

Column 5,
Line 28, delete “fill” and insert therefore -- full --.
Line 39, after “having” delete “,”.

Signed and Sealed this

Ninth Day of August, 2005

JON W. DUDAS
*Director of the United States Patent and Trademark Office*